US010876179B2

(12) United States Patent
Kupetz et al.

(10) Patent No.: US 10,876,179 B2
(45) Date of Patent: Dec. 29, 2020

(54) METHOD FOR PRODUCING HOT-FORMED COMPONENTS

(71) Applicant: Bayerische Motoren Werke Aktiengesellschaft, Munich (DE)

(72) Inventors: Bernd Kupetz, Karlsfeld (DE); Juergen Becker, Reichertshofen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 479 days.

(21) Appl. No.: 15/424,228

(22) Filed: Feb. 3, 2017

(65) Prior Publication Data

US 2017/0145530 A1 May 25, 2017

Related U.S. Application Data

(63) Continuation of application No. PCT/EP2015/066007, filed on Jul. 14, 2015.

(30) Foreign Application Priority Data

Aug. 5, 2014 (DE) ..... 10 2014 215 365

(51) Int. Cl.
*C21D 8/00* (2006.01)
*B21D 22/02* (2006.01)
(Continued)

(52) U.S. Cl.
CPC ..... *C21D 8/005* (2013.01); *B21D 22/022* (2013.01); *B21D 22/201* (2013.01);
(Continued)

(58) Field of Classification Search
None
See application file for complete search history.

(56) References Cited

U.S. PATENT DOCUMENTS 5,916,389 A 6/1999 Lundstroem
7,501,921 B2 * 3/2009 Richards ..... H01F 7/0215 148/103
(Continued)

FOREIGN PATENT DOCUMENTS

CN 201455073 U 5/2010
CN 102304612 A 1/2012
(Continued)

OTHER PUBLICATIONS

Cooksongold, "Technoflux Heat Insulating Paste 120mL", Jan. 27, 2014, Cooksongold (Year: 2014).*
(Continued)

*Primary Examiner* — Alexandra M Moore
*Assistant Examiner* — Adil A. Siddiqui
(74) *Attorney, Agent, or Firm* — Crowell & Moring LLP

(57) ABSTRACT

A method is provided for producing a hot-formed component, in particular a sheet-metal component made of steel, aluminum, magnesium or a combination of the materials. The method includes the acts of: heating a semifinished product, in particular a sheet-metal blank or a pre-shaped sheet-metal component, inserting the semifinished product into a molding tool, and quenching the semifinished product in the molding tool, wherein a change is made to the microstructure of the material at least in one portion. Before the insertion of the semifinished product into the molding tool, an insulating device is applied in at least one predetermined region of the semifinished product. The insulating device is connected in a form-fitting, integral and/or force-fitting manner to the semifinished product.

9 Claims, 1 Drawing Sheet

(51) Int. Cl.

| | |
|---|---|
| ***B21D 22/20*** | (2006.01) |
| ***C21D 1/673*** | (2006.01) |
| ***C22F 1/04*** | (2006.01) |
| ***C22F 1/06*** | (2006.01) |

(52) U.S. Cl.
CPC ..... *B21D 22/208* (2013.01); *C21D 1/673* (2013.01); *C22F 1/04* (2013.01); *C22F 1/06* (2013.01); *C21D 2221/00* (2013.01)

(56) References Cited

U.S. PATENT DOCUMENTS

| | | | | |
|---|---|---|---|---|
| 2002/0104591 | A1* | 8/2002 | Gehringhoff | B21D 53/88 148/320 |
| 2007/0037013 | A1* | 2/2007 | Svensson | B32B 5/16 428/692.1 |
| 2012/0097298 | A1 | 4/2012 | Sommer et al. | |
| 2012/0137498 | A1* | 6/2012 | Lenze | C21D 1/18 29/460 |
| 2012/0304448 | A1* | 12/2012 | Hartmann | B21D 22/208 29/525.06 |

FOREIGN PATENT DOCUMENTS

| | | | |
|---|---|---|---|
| CN | 102665955 | A | 9/2012 |
| CN | 203459536 | U | 3/2014 |
| DE | 197 23 655 | A1 | 12/1997 |
| DE | 200 14 361 | U1 | 10/2000 |
| DE | 197 23 655 | B4 | 5/2007 |
| DE | 10 2009 015 013 | A1 | 11/2010 |
| DE | 10 2009 023 195 | A1 | 12/2010 |
| DE | 10 2012 016 075 | A1 | 12/2013 |
| DE | 10 2013 212 816 | A1 | 1/2015 |
| JP | 2001159497 | A * | 6/2001 |
| WO | WO 2005/021177 | A1 | 3/2005 |
| WO | WO 2010/139664 | A1 | 12/2010 |
| WO | WO 2011/054575 | A1 | 5/2011 |

OTHER PUBLICATIONS

Machine translation of JP-2001159497, Nabeshima, Yoshikazu.*

Wikipedia, "Interference Fit", https://web.archive.org/web/20120730010704/https://en.wikipedia.org/wiki/Interference_fit (Year: 2012).*

International Search Report (PCT/ISA/210) issued in PCT Application No. PCT/EP2015/066007 dated Sep. 22, 2015 with English translation (five pages).

German-language Written Opinion (PCT/ISA/237 ) issued in PCT Application No. PCT/EP2015/066007 dated Sep. 22, 2015 (five pages).

German Search Report issued in counterpart German Application No. 10 2014 215 365.4 dated Jun. 18, 2015 with partial English translation (11 pages).

Chinese-language Office Action issued in counterpart Chinese Application No. 201580022824.1 dated Aug. 1, 2018 with English translation (16 pages).

Chinese-language Office Action issued in counterpart Chinese Application No. 201580022824.1 dated Dec. 4, 2017 with English translation (Fifteen (15) pages).

Chinese-language Office Action issued in counterpart Chinese Application No. 201580022824.1 dated Jun. 4, 2019 with English translation (five (5) pages).

* cited by examiner

METHOD FOR PRODUCING HOT-FORMED COMPONENTS

CROSS REFERENCE TO RELATED APPLICATIONS

This application is a continuation of PCT International Application No. PCT/EP2015/066007, filed Jul. 14, 2015, which claims priority under 35 U.S.C. § 119 from German Patent Application No. 10 2014 215 365.4, filed Aug. 5, 2014, the entire disclosures of which are herein expressly incorporated by reference.

BACKGROUND AND SUMMARY OF THE INVENTION

The invention relates to a method for producing hot-formed components.

In the present-day automotive industry, the comfort of the vehicle occupants is increasingly enhanced by employing special equipment. The latter comprise many electromechanical components such as sensors, motors, actuators, which serve in facilitating the driving task for the driver. However, this increase in comfort at the same time means an increase in the vehicle weight. In order to counteract this, it is attempted in the prior art to design the structural components of the body in a weight-reduced manner.

The structural components of the body are not only significantly involved in terms of the stability of the vehicle but also play a decisive role in terms of safety in the event of a crash. In order for this conflict in terms of competing objectives of reducing the component weight of structural components while at the same time maintaining or implementing, respectively, high mechanical characteristic values to be resolved, it has proven successful in the past for structural components to be produced by way of hot-forming. Hot-forming processes are also described in literature as form hardening or press hardening.

Two methods which are fundamentally different are known for producing form hardened components, in particular for producing body components. In the case of direct hot-forming methods, a metal blank is initially heated in an oven to a temperature that is above the austenitizing temperature of the steel, and subsequently is simultaneously formed and cooled, i.e. form hardened, in a tool. In the indirect hot-forming method, a completely formed and trimmed component of steel is initially generated from a metal blank by cold forming. The component is then heated in a heating plant to a temperature that is above the austenitizing temperature of the steel, and subsequently is form hardened in a tool by rapid cooling. In both hot-forming methods, the metal blank or an already completely formed and trimmed component of steel, subsequent to heating to the austenitizing temperature, is thermomechanically formed in the tool, wherein thermomechanical forming is performed at a temperature that is above the austenitizing final temperature Ac3 (approx. 830° C.), preferably between 900 and 1100° C. Cooling of the formed workpieces is performed by way of a cooling unit which is located in a closed tool body. On account thereof, components having particularly high mechanical properties, in particular having high strength values, may be generated.

DE 19723655 B4 shows a method for producing sheet-metal steel products by heating a cut-to-measure steel panel, hot-forming the steel panel in a pair of tools, hardening the product formed by rapid cooling from an austenitic temperature while said product continues to be held in the pair of tools, and subsequent processing of the product.

DE 197 23 655 A1 describes a method for producing hardened components which have regions of lower hardness and region of higher hardness. Subsequent processing is to take place in these softer regions. In order for the softer regions to be generated, inserts are provided in the processing tools, or gaps are provided between the tool and the workpiece. However, systems of this type have disadvantages in terms of complex geometries being producible only with difficulty. Should the geometry of the component be changed, or should other regions of the component remain non-hardened, modifications to the production tools will be required. However, this is associated with a high modification investment and high costs. During the manufacturing of mass-produced components in high volumes the tool is subjected to heavy wear. However, the properties of the components produced also change due to the signs of wear. The tools have to be reconditioned in order for the requirements in terms of dimensional accuracy and of quality to be met. This is associated with high costs and, moreover, leads to the production process being interrupted.

Proceeding from this prior art, the present invention is based on the object of providing a method for producing hot-formed components in which method different regions having different mechanical values may be configured in a component. It is a special object of the invention to provide a method by way of which modifications to the desired mechanical characteristic values in a component may be implementable in a particularly rapid manner.

This and other objects are achieved by a method according to the invention for producing a hot-formed component, in particular a sheet-metal component of steel, aluminum, magnesium, or of a combination of these materials, the method comprising the following acts:

- heating a semi-finished product, in particular a metal blank or a preformed sheet-metal component,
- introducing the semi-finished product into a forming tool, and
- cooling the semi-finished product in the forming tool, wherein a modification of the material microstructure is carried out at least in a portion. Prior to introducing the semi-finished product into the forming tool, an insulating installation which is connected to the semi-finished product in a form-fitting, materially integral, and/or force-fitting manner is applied in at least one predetermined region of the semi-finished product. The heat transfer from the semi-finished product to the environment, or from the environment to the semi-finished product, respectively, in the predetermined regions is modified in a localized manner by the insulating installation. Predetermined regions are such regions in which the completed component is intended to have softer, more ductile properties than in the remaining regions. The component in the predetermined regions has a ductile deforming behavior. According to the invention, components, for example structural vehicle components, of which the mechanical properties, in particular the hardness thereof, is not homogenous are thus attained. The generation of soft, ductile regions may be performed by the method according to the invention without high investment costs. On account thereof, the method is very well suited to retrospectively adapting the properties of components even when mass production is already underway.

In a first variant of the method, the insulating installation is applied to the semi-finished product prior to heating. On account thereof, it is ensured that the semi-finished product in the predetermined region is subjected to a more minor heat input, not reaching a temperature that is above the austenitizing temperature AC3. A microstructure having a lower ductility than in the remainder of the component is thus established in this predetermined region post hardening. The insulating installation may be removed again post heating of the semi-finished product, prior to the semi-finished product being placed in a hardening tool. Alternatively, the insulating installation may also remain on the semi-finished product while the semi-finished product is being hardened in the hardening tool.

In a second variant of the method, the insulating installation is applied to the semi-finished product in the predetermined region only post heating of the semi-finished product. On account thereof, the semi-finished product, across the entire extent thereof, is completely heated to a temperature that is above the austenitizing temperature AC3. Said semi-finished product, together with the insulating installation disposed thereon, is subsequently introduced into the hardening tool and hardened. The warm semi-finished product in the predetermined region is cooled more slowly than in the remaining regions, since the insulating installation decelerates the flow of heat from the semi-finished product to the tool.

In both variants of the method a martensitic microstructure that is distinguished by high mechanical hardness is generated in the component. A ferritic-pearlitic microstructure which is more ductile than the martensitic regions(s) is established in those regions that are covered by the insulating installation.

The position of the insulating installation on the semi-finished product may be modified, depending on the position of the semi-finished product at which more ductile regions are to be set. The insulating installation covers that region of the semi-finished product that, in the completed component, must not attain excessive strength-related characteristic values. Moreover, depending on the mechanical characteristic values to be attained, different insulating installations, which differ in terms of the thickness or the material thereof, may be applied to the semi-finished product.

According to a first embodiment of the invention, the insulating installation may be configured as a permanent magnet and be connected to the semi-finished product in a force-fitting manner. Since the semi-finished products are preferably configured as metallic panels, magnets are particularly suitable for use as an insulating installation, since said magnets automatically adhere to the semi-finished product. A further advantage of permanent magnets is that the former, post hardening, may be removed without residue from the component, cleaning or preparing of the components not being necessary, respectively.

According to a second embodiment of the invention, an insulating installation that is configured as a foil/film or tape is applied to the semi-finished product. By virtue of the minor thickness thereof, tapes or foils/films offer the advantage that in the production method the tapes or foils/films may be applied to the tools without modifications or only minor tool modifications, respectively. Thus, the tapes or foils/films are also particularly well suited to being retrospectively employed in the production method, during a production of volume components that has already been started up. Such tapes or foils/films may be configured in a layered manner, having a minor layer thickness. In order to be fastened to the semi-finished product, the tapes or foils/films may be connected to the semi-finished product by way of an adhesion-imparting layer, for example of an adhesive. Good retention of the insulating installation on the semi-finished product advantageously results from a materially integral connection of this type.

According to a third embodiment, an insulating installation which is configured as a paste is applied in a predetermined region of the semi-finished product onto the latter. Such pastes may be copper pastes, for example, or similar pastes that have a low coefficient of heat transfer. Pastes are also suitable for retrospective use in already started-up volume productions.

According to a fourth embodiment, an insulating installation which is configured as a form-fitting cover coat is applied in a predetermined region of the semi-finished product. This cover coat may be configured from various materials that are correspondingly resistant to temperature. For example, a cover coat of this type may be configured from an additional sheet-metal panel which, in the predetermined region, can be brought to engage with the semi-finished product. Alternatively, the cover coat may also be configured from a heat-resistant plastic material which may be brought to engage in a form-fitting manner with the predetermined region of the semi-finished product.

A plurality of insulating installations may be disposed on the semi-finished product in all embodiments described. The insulating installations may all be disposed on a first side of the semi-finished product, or on a side that is opposite the first side of the semi-finished product. Furthermore, the insulating installations may also be provided on both sides of the semi-finished product. Herein, the insulating installations may be mutually offset or in the predetermined region be disposed on both sides of the semi-finished product.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1A:
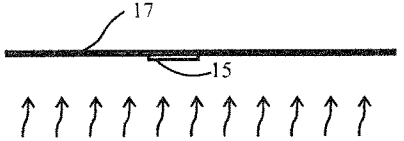
FIGS. 1*a*-1*c* illustrate method steps according to the first method variant.
Figure 1B:
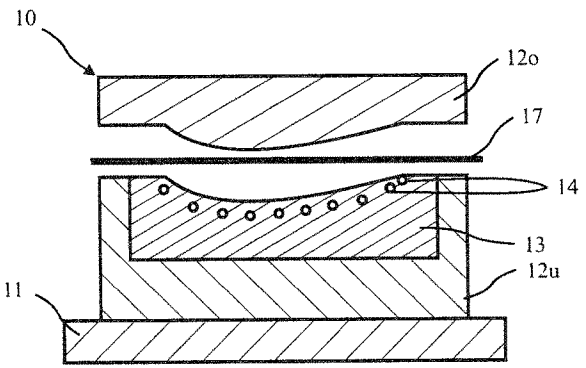
Figure 1C:
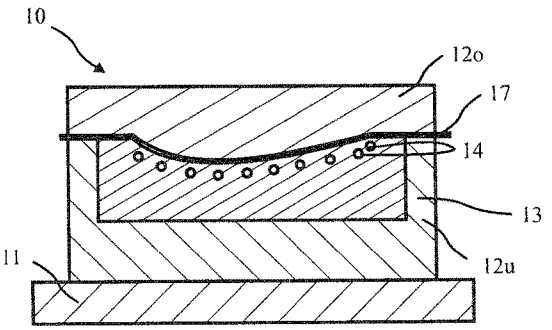

The method steps that are carried out in the case of direct hot-forming according to a first variant of the method are depicted in FIGS. 1*a*-1*c*. The heating step in which a semi-finished product 17, illustrated here as a metal blank, is heated is illustrated in FIG. 1*a*. Heating may be performed in an oven or with the aid of another heat source. The insulating installation 15 has already been attached to a predetermined position and shields a predetermined region of the metal blank 17. The heat, illustrated as s-shaped curved arrows, in this region reaches the metal blank 17 only to a comparatively minor extent, heating the latter in the predetermined region to a lower temperature than in the remaining regions of the metal blank 17.

FIG. 1*b* shows a forming tool 10 which is employable in presses in order for sheet-metal blanks to be hot-formed into sheet-metal components 17. The forming tool 10 has a lower tool half 12*u* which sits on top of a base plate 11. The lower forming tool half 12*u* interacts with an upper forming tool half 12*o*. The mutually facing operating faces of the upper forming tool half 12*o* and of the lower forming tool half 12*u* are configured in a corresponding manner such that said faces function like a die and a ram of a pressing tool. In the case of the example illustrated in FIG. 1*b*, the tool half 12*o* is configured as a ram, and the tool half 12*u* is configured as a die. The upper and the lower forming tool half, in terms of the arrangement thereof, may be swapped without departing from the scope of the invention, so that the upper tool functions as the die, and the lower tool functions as the ram. The upper tool half 12*o* and the lower tool half 12*u* are movable in relation to one another. The forming tool halves 12*o*, 12*u*, illustrated in FIG. 1*b*, may be diverged and converged again. When the forming tool halves are being converged, the semi-finished product 17, i.e. a piece of sheet metal, or a sheet-metal blank 17, comes to lie between the forming tool halves, being encompassed and formed by the operating faces. The state illustrated in FIG. 1*b* corresponds to an opened position of the tool halves 12*u*, 12*o*, in the case of a forming procedure in which the component 17 has been completely formed and may be removed from the forming tool 10. In the illustration, the insulating installation 15 is removed from the sheet-metal blank 17 post heating.

An insert 13, in which a cooling system which has a plurality of cooling ducts or cooling lines 14 is integrated, is provided in the lower forming tool half 12*u*. On the one hand, the use of inserts 13 of this type offers the advantage that various component contours may be pressed using one lower forming tool 12*u*, in that the insert 13 may be replaced according to the desired shape of the component. The cooling lines 14 run so as to be substantially parallel with the surface of the component 17, and thus also substantially parallel with the operating face of the forming tool halves 12*u*, 12*o*. The cooling lines 14 thus follow the component surface at a certain spacing therefrom into the insert 13 of the lower forming tool half 12*u*. Targeted cooling of the semi-finished product 17 in the region of the cooling ducts 14 is enabled by way of the cooling ducts, such that the component is hardened and a microstructure having high mechanical strength values is implemented in the component.

The forming tool 10 known from FIG. 1*b* is illustrated in FIG. 1*c*, the former however being in a closed position. In this state, the sheet-metal part 17 has been formed and is being hardened. Herein, heat is extracted from the component 17 and discharged by way of the cooling ducts 14.

Figure 2A:
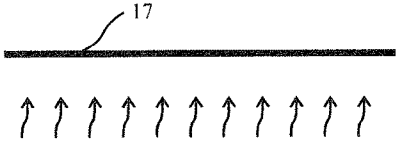
FIGS. 2*a*-2*c* illustrate method steps according to the second method variant.
Figure 2B:
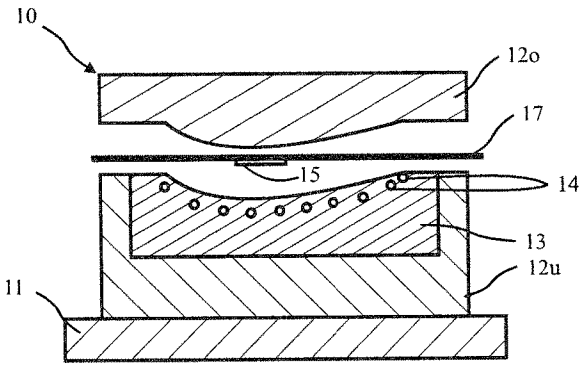
Figure 2C:
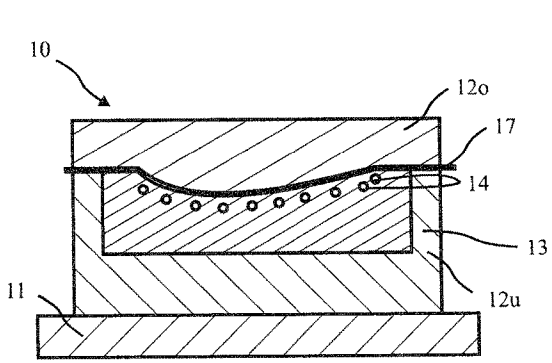

A second variant of the method is illustrated in FIGS. 2*a* to 2*c*. In the case of this variant, the metal blank 17 is completely heated, as is illustrated in FIG. 2*a*. Prior to the metal blank 17 being introduced into the forming tool 10, the insulating installation 15 is applied in a predetermined region to the metal blank 17, for example on a lower side of the semi-finished product 17, i.e. on that side that faces the lower tool half 12*u*. Thereafter, the metal blank 17 having the insulating installation 15 disposed thereon is introduced into the forming tool 10, as is depicted in FIG. 2*b*. During forming and hardening, illustrated in FIG. 2*c*, the insulating installation 15 influences the heat exchange between the semi-finished product 17 and the tool 10. That region of the semi-finished product 17 in which the insulating installation 15 is disposed corresponds to a predetermined region in which high mechanical characteristic values are not desired. Instead, a region having comparatively high ductility is to be implemented here. By way of the insulating installation 15, the semi-finished product 17 in the predetermined region is subjected to slower cooling than in the remaining regions. On account thereof, a pearlitic-ferritic material microstructure that imparts higher ductility to the region is configured here.

While FIGS. 1*a* to 1*c* and 2*a* to 2*c* describe the invention by means of the direct hot-forming method, the invention may also be applied in the indirect method. Herein, the sheet-metal blank is initially cold-formed to become a three-dimensional semi-finished product. The latter is thereafter heated and, without further forming or optionally with only minimum forming, is then hardened. Post cold-forming, the first or the second variant may be selectively applied as has been described above, wherein the insulating installation 15 prior to heating or prior to hardening is applied to a predetermined region of the three-dimensional semi-finished product.

In the figures, only the lower tool half 12*u* is provided with cooling ducts 14. Alternatively, in further embodiments of the invention, the arrangement of cooling lines may also be disposed in the upper tool half 12*o*. In one further alternative embodiment, cooling ducts 14 may be provided in both the upper tool half 12*o* as well as in the lower tool half 12*u*.

Figure 3:
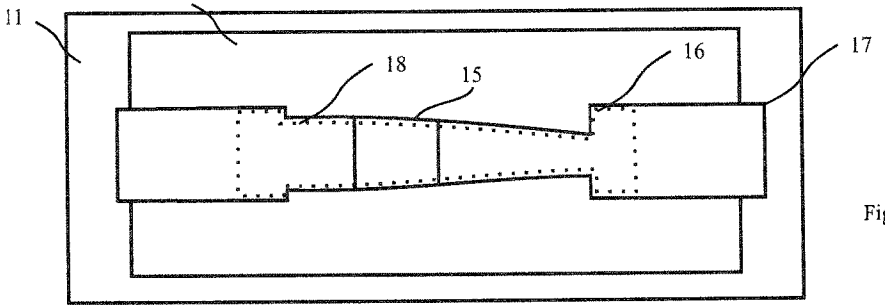
FIG. 3 illustrates an exemplary structural component.

FIG. 3 shows a plan view of a lower tool part 12*u* of the forming tool 10. A semi-finished product 17 for producing a B-pillar 18 is configured here in an exemplary manner. The semi-finished product 17 is cut along the dashed contour in order to obtain the B-pillar 18 as a component. This may be selectively carried out prior to or post hot-forming. Alternatively, other vehicle components or structural vehicle components may also be produced. Such components may in particular be A-pillars or C-pillars, lateral roof rails, roof bows, sills, longitudinal beams or cross beams.

LIST OF REFERENCE SIGNS

10 Forming tool
11 Tool base plate
12*u* Lower tool part
12*o* Upper tool part
13 Tool insert
14 Cooling lines
15 Insulating installation
16 Component
17 Semi-finished product The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a hot-formed component, the method comprising the acts of:

heating a semi-finished product;

prior to introducing the semi-finished product into a forming tool, applying insulating installation in the form of a permanent magnet to the semi-finished product in a form-fitting, materially integral, and/or force-fitting manner in at least one predetermined region of the semi-finished product;

introducing the heated semi-finished product with insulation installation into the forming tool; and cooling the semi-finished product in the forming tool, wherein a cooling rate in a portion of the semi-finished product covered by the insulation material is such that an microstructure is formed in the portion covered by the insulation material is more ductile than a microstructure formed in a portion of the semi-finished product that is not covered by the insulation material.

2. The method according to claim 1, wherein the component is made of steel, aluminum, magnesium, or a combination of these materials.

3. The method according to claim 2, wherein the semi-finished product is a metal blank or a preformed sheet-metal component.

4. The method according to claim 1, wherein the insulating installation is disposed on the semi-finished product prior to heating.

5. The method according to claim 4, wherein the insulating installation is disposed on the semi-finished product prior to heating, and is removed from the semi-finished product post heating.

6. The method according to claim 4, wherein the insulating installation is disposed on the semi-finished product prior to heating, and is left on the semi-finished product post heating of the semi-finished product and during hardening.

7. The method according to claim 1, wherein the insulating installation is disposed on the semi-finished product prior to heating, and is removed from the semi-finished product post heating.

8. The method according to claim 1, wherein the insulating installation is disposed on the semi-finished product prior to heating, and is left on the semi-finished product post heating of the semi-finished product and during hardening.

9. The method according to claim 1, wherein the insulating installation is disposed on the semi-finished product post heating, and remains on the semi-finished product during hardening.

* * * * *